US006188210B1

(12) United States Patent
Tichauer et al.

(10) Patent No.: US 6,188,210 B1
(45) Date of Patent: Feb. 13, 2001

(54) METHODS AND APPARATUS FOR SOFT START AND SOFT TURNOFF OF LINEAR VOLTAGE REGULATORS

(75) Inventors: Larry Tichauer, La Palma; Rodger Erickson, Tarzana; Timothy Freitas, Culver City; Xianjun Mao, Monterey Park, all of CA (US)

(73) Assignee: Ophir RF, Inc., Los Angeles, CA (US)

( * ) Notice: Under 35 U.S.C. 154(b), the term of this patent shall be extended for 0 days.

(21) Appl. No.: 09/483,270

(22) Filed: Jan. 13, 2000

(51) Int. Cl.[7] ..... G05F 1/44
(52) U.S. Cl. ..... 323/273; 323/901
(58) Field of Search ..... 323/273, 274, 323/901; 363/49

(56) References Cited

U.S. PATENT DOCUMENTS 4,318,039 * 3/1982 Abbott ..... 323/273
5,852,359 * 12/1998 Callahan, Jr. et al. ..... 323/274
5,939,870 * 8/1999 Nguyen et al. ..... 323/282

* cited by examiner

*Primary Examiner*—Adolf Deneke Berhane
(74) *Attorney, Agent, or Firm*—Blakely, Sokoloff, Taylor & Zafman LLP

(57) ABSTRACT

Methods and apparatus for the soft start of linear regulators for controlling inrush current. In linear regulators having a pass transistor controlled by a regulator control circuit, the regulator control circuit is disabled until the regulator output reaches a predetermined threshold level. On startup, an additional transistor is coupled with a resistor and capacitor to the control terminal of the pass transistor in such a way as to provide for the slow turn-on of the pass transistor. During this time, the control circuit for the pass transistor is held inoperative. After the regulator output reaches a predetermined threshold, the pass transistor control circuit becomes operative and the slow start circuitry becomes inoperative.

15 Claims, 2 Drawing Sheets

METHODS AND APPARATUS FOR SOFT START AND SOFT TURNOFF OF LINEAR VOLTAGE REGULATORS

BACKGROUND OF THE INVENTION

1. Field of the Invention

The present invention relates to the field of linear regulators.

2. Prior Art

Linear voltage regulators are well known in the prior art, being commonly used to receive an unregulated input voltage and to provide a regulated output voltage somewhat lower than the input voltage. Such regulators comprise a pass transistor coupled between the input to the regulator and the output of the regulator, and a pass transistor control circuit controlling the control terminal of the pass transistor based upon the comparison of a reference voltage with the output voltage of the regulator, typically as divided down by a resistor divider.

The foregoing types of linear regulators work well and are widely used. Such regulators are widely commercially available in integrated circuit form, the lower power regulators including the pass transistor as part of the integrated circuit and the higher power regulators using an external discrete pass transistor. However, unless some provision is made for the soft start of such regulators, the pass transistor will be turned on hard when power is first applied to the regulator, drawing an initial high current spike from the power supply. In that regard, substantial energy may be initially required at the output of the regulator if there is a substantial capacitive load thereon, whether because of the circuitry being driven by the regulator, or merely the presence of the typical smoothing capacitor normally provided on the output of the regulator. Substantial energy also may be initially required at the output of the regulator due to nonlinear loads where the nonlinearity is a function of voltage.

To limit the inrush current on turn-on, a resistor is commonly coupled in series with the regulator circuit, with the pass transistor control circuit sensing the voltage drop across the resistor and controlling the control terminal of the pass transistor to limit that current to a predetermined maximum value. That maximum current, of course, must be higher than the maximum expected load on the regulator in normal operation. Accordingly, when a system using such regulators is first turned on, there will be a momentary load on the power supply exceeding the largest load expected during normal operation of the system, caused by the simultaneous extraordinary inrush currents of all the circuits in the system. Further, the system itself may have various circuits, not all of which could operate at their maximum power requirements at the same time. Accordingly, the maximum normal operating power requirements from the power supply may be much less than the momentary power requirement on first turn-on of the system. Consequently, the inrush current requirements of a system can often determine the minimum power supply size, weight and cost, even though the normal operation of the system would only require a smaller, lighter and less costly supply.

In addition, in many systems it is desired to be able to replace a printed circuit board without shutting off power to the system, typically referred to as "hot swapping." In computer systems, hot swapping will allow the replacement of a board or the addition of a new board without loss of information in volatile memory, without requiring rebooting the system, etc. In systems such as communication systems and the like, wherein a plurality of boards of similar function are plugged into a motherboard, boards may be hot swapped or additional boards added without shutting down the system. This allows maintenance and upgrading without interfering with communications or other functions in channels serviced by the remaining boards in the system. In hot swapping applications, however, unless inrush currents are adequately limited, the addition of a board to a system in operation can cause a momentary power glitch which may disturb other circuits in the system.

A similar effect is encountered when a circuit is shut down. In this case, when an existing electrical load of the circuit is suddenly removed, an over-voltage condition may be imposed on the other circuits in the system, causing a temporary or permanent disruption in their operation. Also, if the load on a switching power supply if drastically reduced, the switching power supply may latch in a shutdown condition.

BRIEF SUMMARY OF THE INVENTION

Methods and apparatus for the soft start and/or soft turnoff of the pass transistor of linear regulators for controlling inrush current are described. On startup, an additional transistor is coupled with a resistor and capacitor to the control terminal of the pass transistor in such a way as to provide for the slow turn-on of the pass transistor. During this time, the control circuit for the pass transistor is held inoperative. After the regulator output reaches a predetermined threshold, the pass transistor control circuit becomes operative and the slow start circuitry becomes inoperative. On shutdown, the reverse process occurs, providing a slow turn-off of the pass transistor. While exemplary embodiments using P-MOS transistors for regulating the positive power supply connection is disclosed, the circuit may be readily converted for use in regulating a negative power supply connection. Also, other transistor types may be used, such as bipolar junction transistors.

DETAILED DESCRIPTION OF THE PREFERRED EMBODIMENT

Figure 1:
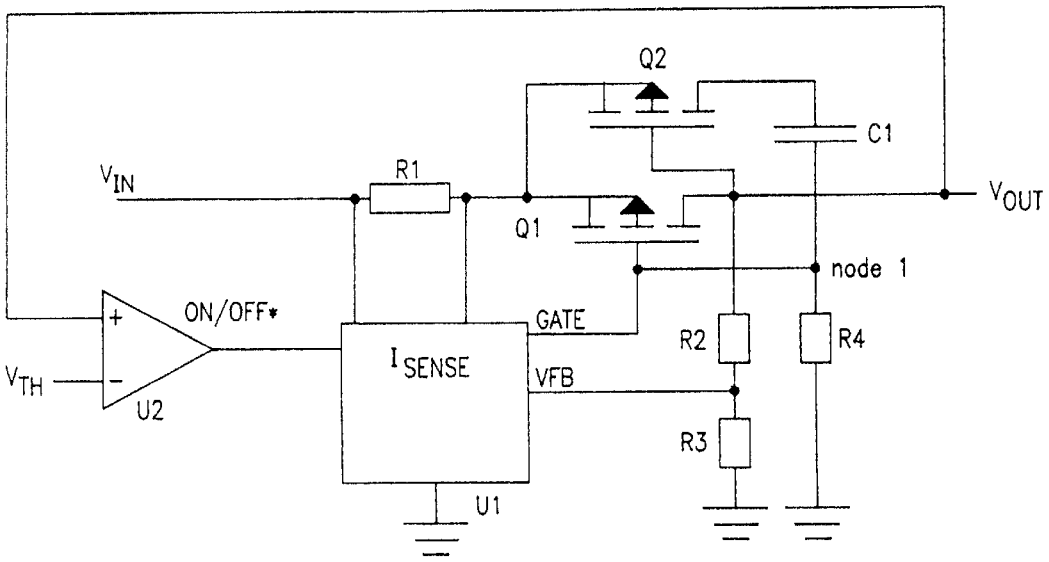
FIG. 1 is a circuit diagram for an exemplary embodiment of the present invention having a soft turn-on capability.

Now referring to FIG. 1, an exemplary embodiment of the present invention having a soft start capability may be seen. As shown therein, a pass transistor controller U1 receives a feedback signal VFB equal to the output voltage $V_{OUT}$ divided down by a resistor divider comprised of resistors R2 and R3. This feedback voltage is compared with the reference voltage, in the embodiment shown in FIG. 1 generated within the pass transistor controller U1, with the pass transistor controller controlling the gate of transistor Q1 to maintain a match between the feedback voltage VFB and the reference voltage, internally generated or otherwise. In the specific embodiment shown in FIG. 1, the pass transistor Q1 is a PMOS device coupled between the input VIN and the output $V_{OUT}$, the ground terminal being common to both the input and output circuits. It should be noted, however, that in other embodiments, other types of transistors may be used, such as junction transistors. Alternatively the pass device may be on the negative side of the circuit, so that the higher voltage power supply terminal is common between the regulator input and output, with the pass transistor being in the lower voltage connection between the input and output. By way of a more specific example, the regulator may be used to regulate a negative voltage relative to ground, wherein typically an NMOS device or an npn transistor would be used.

In addition, resistor R1 is coupled between the input $V_{IN}$ and the source of transistor Q1, with the voltage across resistor R1 providing the current sense signal $I_{SENSE}$ to the pass transistor controller U1 to allow the pass transistor controller to limit the maximum current drawn by the regulator. The pass transistor controller, the current sense resistor R1 and pass transistor, such as transistor Q1, are generally found in linear regulators, either as part of a single integrated regulator circuit for low power applications, or alternatively, the pass transistor controller may be an integrated circuit, with the sense resistor and pass transistor being discrete components.

In the specific exemplary embodiment shown in FIG. 1, the pass transistor controller U1 is an integrated circuit controller manufactured by National Semiconductor. This controller, as is typical of many integrated circuit controllers for controlling a discrete pass transistor, has an $I_{SENSE}$ input for sensing the current (voltage drop) across a current sensing resistor (R1 in FIG. 1) and a feedback voltage input VFB for receiving a feed back of a fraction of the output voltage $V_{OUT}$ determined by user selected resistors R2 and R3 and for providing a gate control signal GATE for controlling the gate of the pass transistor (transistor Q1 in FIG. 1) responsive thereto. The integrated circuit pass transistor controller, as is also typical of such integrated circuit controllers, includes an on/$\overline{\text{off}}$ or $\overline{\text{standby}}$ input signal, making the controller active when the on/$\overline{\text{off}}$ or $\overline{\text{standby}}$ signal is high, and disabling the gate control output of the controller when the signal is low. The integrated circuit controller used with the exemplary embodiment has a gate control circuit controlling the gate control signal GATE which, when inactive, provides a 500K pull-up resistor within the integrated circuit controller to pull the gate voltage of transistor Q1 high to hold the transistor off.

In the exemplary embodiment of the present invention shown in FIG. 1, resistor R4, capacitor C1, transistor Q1 and comparator U2 have been added to provide the desired soft start. With the addition of these components, the operation of the circuit may be described as follows. When the input voltage $V_{IN}$ is off, the voltages at the various nodes of the circuit will generally be at ground potential. Then, immediately after the circuit is turned on, the output voltage $V_{OUT}$ will initially again be at ground potential, with comparator U2 comparing the output voltage $V_{OUT}$ with the threshold voltage $V_{TH}$, providing a low comparator output to hold the pass transistor controller U1 inactive. The source of transistor Q2, connected to the current sense resistor R1, will follow the input voltage $V_{IN}$. The gate of transistor Q2, connected to the output voltage $V_{OUT}$, will of course also initially be at ground potential, turning on transistor Q2 to couple the input voltage $V_{IN}$ through resistor R1 and transistor Q2 to capacitor C1. This initially drives node 1 high, holding the gate of transistor Q1 high in cooperation with the pull-up resistor within the integrated circuit pass transistor controller U1. However, the capacitor C1 will now begin to charge with an RC time constant determined by resistor R4, capacitor C1 and the pull-up resistor within the integrated circuit pass transistor controller, which may or may not be large in comparison to the resistor R4. As capacitor C1 charges, the voltage on node 1 decreases, slowly turning on transistor Q1, causing the output voltage $V_{OUT}$ to increase at a rate responsive to the load thereon, the RC time constant of resistor R4, capacitor C1, the internal resistor of the controller and the turn-on characteristics of transistor Q1.

When the output voltage $V_{OUT}$ reaches the threshold voltage $V_{TH}$ on the negative terminal of comparator U2, the output of the comparator will go high, activating the pass transistor controller U1. Now the pass transistor controller takes over, driving the gate control signal GATE controlling the gate of transistor Q1 to bring the regulator into regulation. As the output voltage $V_{OUT}$ further increases toward regulation, transistor Q2 turns off because of the decreasing source-gate voltage on the transistor, so that the integrated circuit pass transistor controller may have full control of the gate control signal GATE for transistor Q1 unaffected by the capacitor C1. The output impedance of the circuit driving the gate control signal GATE when the integrated circuit pass transistor is active is low compared to the resistance of resistor R4. This allows the controller to control the gate of transistor Q1 substantially independent of the presence of the additional resistor R4.

If the input voltage $V_{IN}$ is now turned off, both the input voltage $V_{IN}$ and the output voltage $V_{OUT}$ will drop, so that transistor Q2 may remain off during the shutdown of the circuit. Capacitor C1, being charged to a substantial voltage, will tend to retain that charge. However, transistor Q2 is a PMOS transistor having its body connected to its source. As the circuit is shut off, the voltage on capacitor C1 will forward bias the pn junction between the drain of transistor Q2 and the body thereof, discharging capacitor C1 through that pn junction. Therefore the voltage on capacitor C1 which can be maintained with $V_{IN}$ and $V_{OUT}$ both at ground potential cannot exceed one forward bias pn junction voltage drop. Consequently, the circuit will reset itself for immediate functioning again in the event power ($V_{IN}$) is provided and momentarily lost, such as can occur when inserting a board into an already hot system.

Referring again to FIG. 1, it may be seen that capacitor C1 is decoupled from the control of the gate of transistor Q1 during normal operation of the regulator by the turn-off of transistor Q2. Accordingly, the threshold of transistor Q2 should be chosen to be greater than the maximum difference between the input voltage $V_{IN}$ and the output voltage $V_{OUT}$. This normally is not a problem, as linear regulators are normally used in applications wherein the unregulated input voltage $V_{IN}$ is some percentage range higher than the desired regulated output voltage $V_{OUT}$, not a number of times the desired regulated output voltage $V_{OUT}$. At the other extreme, the threshold of transistor Q2 should be substantially less than the input voltage $V_{IN}$ itself, to be sure that the transistor initially turns on, as desired, to pull node 1 high and allow the same to decrease in voltage at a controlled rate by the charge of capacitor C1 through resistor R4. Alternatively, as shown in FIG. 2, the gate of transistor Q2 may be coupled to the output $V_{OUT}$ through a resistor divider R5,R6, either fixed or adjustable such as a potentiometer, to provide a circuit adjustment for specific transistor thresholds or variations in transistor threshold.

In the circuit shown in FIG. 1, the threshold voltage $V_{TH}$ used by comparator U2 does not determine the accuracy of regulation of the regulator, but rather merely determines when the pass transistor control circuit will take control of the pass transistor. As such, the threshold voltage $V_{TH}$ need not be a particularly accurate voltage and could be generated various ways, such as, by way of example, with a resistor and zener diode connected to VIN, or even a resistor divider connected to VIN, provided the various circuit and operating parameters assure that the pass transistor control circuit will take control before the output voltage $V_{OUT}$ reaches or exceeds the regulated output voltage.

Figure 2:
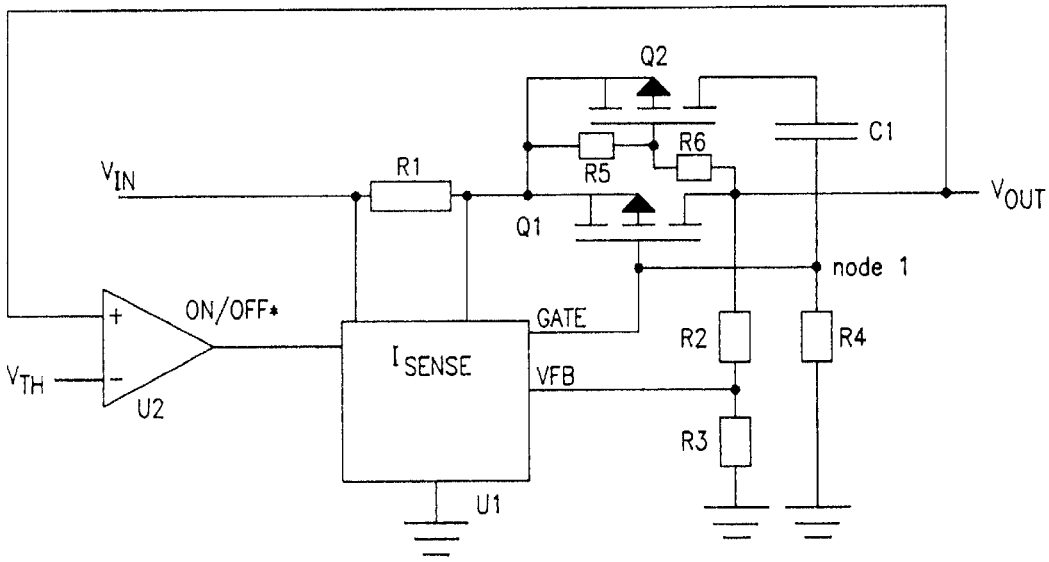
FIG. 2 is a circuit diagram for an alternate embodiment of the present invention also having a soft turn-on capability.
Figure 3:
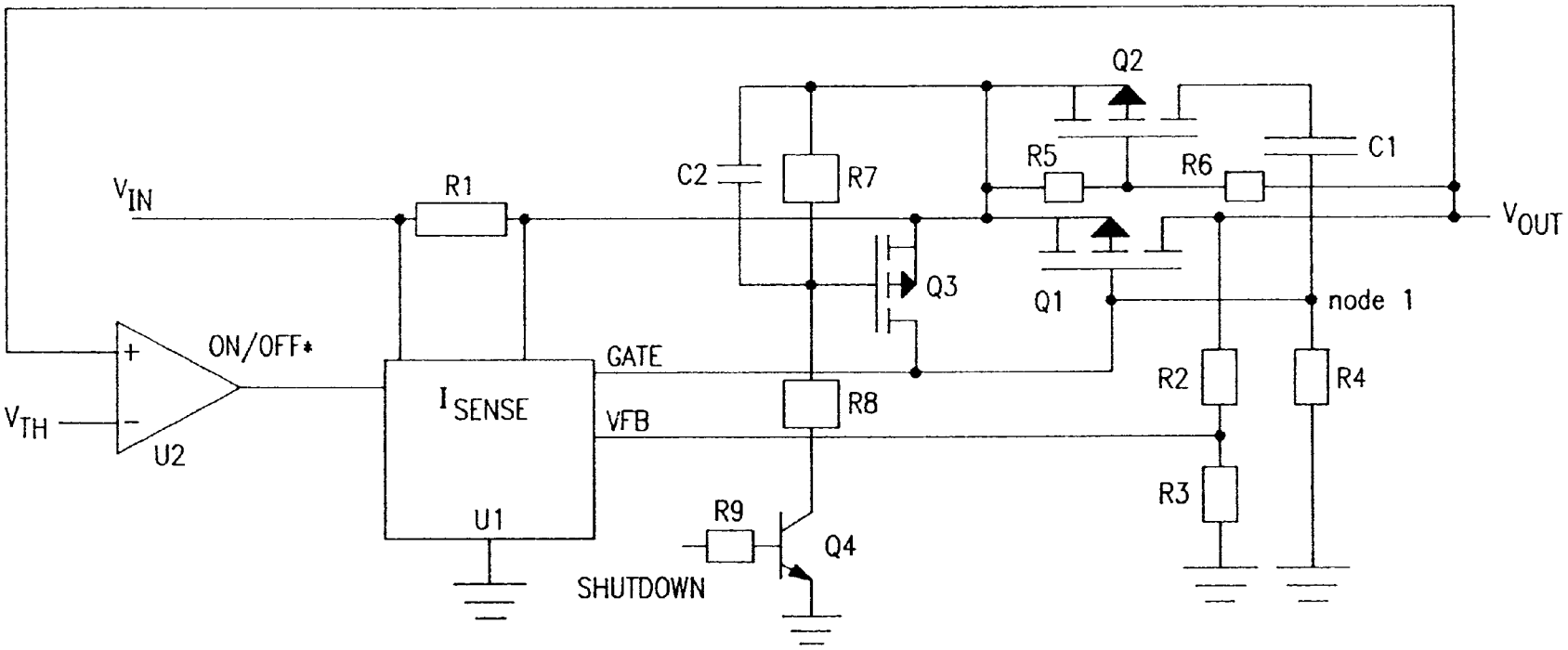
FIG. 3 is a circuit diagram for a still further alternate embodiment of the present invention having a soft turn-on and a soft turn-off capability.

Now referring to FIG. 3, the exemplary circuit of FIG. 2 further including additional exemplary circuitry for accomplishing a soft shutdown may be seen. The soft shutdown presumes that power to the circuit is maintained during the shutdown, with the shutdown being controlled by a Shutdown signal applied to the base of transistor Q4 through resistor R9.

In addition to transistor Q4 and resistor R9, the exemplary soft shutdown circuitry includes p-channel transistor Q3, resistors R7 and R8 and capacitor C2. Before power to a printed circuit board containing the circuitry of FIG. 3 is applied, the shutdown signal will be low, so that transistor Q4 will be off. Resistor R7 will result in capacitor C2 being discharged. When power to the printed circuit board is applied, generally the shutdown signal will be low, holding transistor Q4 off. Capacitor C2 and resistor R7 will pull the gate of transistor Q3 to the source voltage of transistor Q3, holding the transistor off. Consequently, the soft shutdown circuitry is inactive, and the soft start circuitry will operate as previously described.

When the Shutdown signal is driven high, transistor Q4 will turn on. Now capacitor C2 will start to charge through resistor R8. By proper selection of resistors R7 and R8, the voltage on the gate of transistor Q3 may be made to decrease sufficiently in comparison to the source of transistor Q3 to turn on the transistor. This pulls the gate of p-channel transistor Q1 to its source voltage, overriding (disabling) the pass transistor controller U1 and turning off transistor Q1 to shut down the circuitry connected to $V_{OUT}$. The rate at which transistor Q3 is turned on and thus the rate at which transistor Q1 is turned off will depend on the time constant of the R-C circuit comprising capacitor C2 and resistors R7 and R8. Similarly, on removal of the shutdown signal (change of the signal to the opposite state), the rate at which transistor Q3 is turned off and thus the rate at which transistor Q1 is turned on to the regulating state will also depend on the time constant of the R-C circuit comprising capacitor C2 and resistors R7 and R8.

Even if a board using the circuit of FIG. 3 is plugged into a hot motherboard connector having the shutdown signal high, the circuitry will perform properly. In particular, the soft start circuitry will begin to operate, though when the soft shutdown circuitry begins to turn on transistor Q3, that transistor will begin to override (disable) any other drive provided through passive elements to the gate of transistor Q1, including the pass transistor controller U1, to force the soft shutdown regardless of the state of the soft startup. If desired, by selection of the relative parameters determining the characteristics of the soft startup and the soft shutdown, the shutdown could prevent any circuit startup from beginning to occur.

In use of the present invention, different boards in a system might use different time constants for resistor R4 and capacitor C1, so that the inrush current when the entire system is turned on is further limited. Similarly, different boards in a system might use different time constants for the circuit of capacitor C2 and resistors R7 and R8 to provide varied soft shutdown times. Also, while an exemplary embodiment using an integrated circuit controller for a discrete p-channel transistor for regulating the positive power supply connection is disclosed, the circuit may be readily converted for use in regulating a negative power supply connection using complementary transistors, or using a controller fabricated using discrete components. Also, other transistor types may be used, such as bipolar junction transistors. Thus, while certain preferred embodiments of the present invention have been disclosed and described herein, it will be understood by those skilled in the art that various changes in form and detail may be made therein without departing from the spirit and scope of the invention.

What is claimed is:

1. A soft start linear regulator having an input terminal, an output terminal and a common terminal, comprising:

a pass transistor and a second transistor, each transistor having first and second terminals and a control terminal, the voltage between the first terminal and the control terminal controlling the conduction between the first and second terminals of the respective transistor;

a pass transistor controller coupled to the output terminal and the control terminal of the pass transistor;

a resistor;

a capacitor;

the pass transistor having its first terminal coupled to the input terminal and its second terminal coupled to the output terminal;

the second transistor having its first terminal coupled to the first terminal of the pass transistor, its control terminal coupled to the output terminal and its second terminal coupled to the capacitor, the capacitor being coupled to the resistor and the control terminal of the pass transistor, the resistor being coupled to the common terminal;

the voltage across the resistor controlling the voltage on the control terminal of the pass transistor during startup and the pass transistor controlling the voltage on the control terminal of the pass transistor after startup.

2. The linear regulator of claim 1 wherein the pass transistor controller is disabled during startup.

3. The linear regulator of claim 2 further comprised of a comparator coupled to the output of the regulator and a reference voltage, the comparator enabling the pass transistor controller when the voltage on the output terminal during startup reaches a predetermined voltage.

4. The linear regulator of claim 1 further comprised of a second resistor coupled between the input terminal and the first terminal of the pass transistor and coupled to the pass transistor controller.

5. The linear regulator of claim 1 wherein the input terminal is a positive power supply terminal and the common terminal is a negative power supply terminal.

6. The linear regulator of claim 5 wherein the pass transistor and the second transistor are PMOS transistors.

7. A method of soft starting a linear regulator having a pass transistor and a pass transistor controller comprising:

providing an RC circuit coupled to the control terminal of the pass transistor;

during startup, controlling the pass transistor through the RC circuit so that the pass transistor allows current to flow to an output of the linear regulator at a rate responsive to the RC time constant of the RC circuit; and after startup, de-coupling the RC circuit from the control terminal of the pass transistor, coupling the pass transistor controller to the control terminal of the pass transistor, and controlling the pass transistor by the pass transistor controller to regulate a voltage at the output of the linear regulator.

8. The method of claim 7 wherein startup is determined by a comparison between the output of the linear regulator and a reference voltage.

9. A soft shutdown linear regulator having an input terminal, an output terminal and a common terminal, comprising:

a pass transistor and a second transistor, each transistor having first and second terminals and a control terminal, the voltage between the first terminal and the control terminal controlling the conduction between the first and second terminals of the respective transistor;

a pass transistor controller coupled to the output terminal and the control terminal of the pass transistor;

the pass transistor having its first terminal coupled to the input terminal and its second terminal coupled to the output terminal;

the second transistor having its first terminal coupled to the first terminal of the pass transistor, its control terminal coupled to an R-C circuit and its second terminal coupled to the control terminal of the first transistor; and, a shutdown control circuit responsive to a shutdown signal having two states to control the R-C circuit, the shutdown control circuit responding to a change in the shutdown signal from the first state to the second state to turn on the second transistor with a time constant associated with the R-C circuit.

10. The soft shutdown linear regulator of claim 9 wherein the shutdown control circuit is responsive to a change in the shutdown signal from the second state to the first state to turn off the second transistor with a time constant associated with the R-C circuit.

11. The linear regulator of claim 9 wherein the pass transistor controller is disabled during shutdown.

12. The linear regulator of claim 9 wherein the input terminal is a positive power supply terminal and the common terminal is a negative power supply terminal.

13. The linear regulator of claim 12 wherein the pass transistor and the second transistor are p-channel transistors.

14. A soft start and soft shutdown linear regulator having an input terminal, an output terminal and a common terminal, comprising:

a pass transistor and second and third transistors, each transistor having first and second terminals and a control terminal, the voltage between the first terminal and the control terminal controlling the conduction between the first and second terminals of the respective transistor;

a pass transistor controller coupled to the output terminal and the control terminal of the pass transistor;

a resistor;

a capacitor;

the pass transistor having its first terminal coupled to the input terminal and its second terminal coupled to the output terminal;

the second transistor having its first terminal coupled to the first terminal of the pass transistor, its control terminal coupled to the output terminal and its second terminal coupled to the capacitor, the capacitor being coupled to the resistor and the control terminal of the pass transistor, the resistor being coupled to the common terminal;

the voltage across the resistor controlling the voltage on the control terminal of the pass transistor during startup and the pass transistor controlling the voltage on the control terminal of the pass transistor after startup;

the third transistor having its first terminal coupled to the first terminal of the pass transistor, its control terminal coupled to an R-C circuit and its second terminal coupled to the control terminal of the first transistor; and, a shutdown control circuit responsive to a shutdown signal having two states to control the R-C circuit, the shutdown control circuit responding to a change in the shutdown signal from the first state to the second state to turn on the third transistor with a time constant associated with the R-C circuit.

15. The soft start and soft shutdown linear regulator of claim 14 wherein the shutdown control circuit is responsive to a change in the shutdown signal from the second state to the first state to turn off the third transistor with a time constant associated with the R-C circuit.

* * * * *